US011013379B2

(12) United States Patent
Duong et al.

(10) Patent No.: US 11,013,379 B2
(45) Date of Patent: May 25, 2021

(54) HARNESS AND BACK PACK VACUUM CLEANER THEREFORE

(71) Applicant: Electrical Home-Aids Pty Ltd., Glen Waverley (AU)

(72) Inventors: Hiep Duong, Glen Waverley (AU); David Kim Scott, Feilding (NZ); Daniel Mark Starkey, Glen Waverley (AU); Shanon Matthew Martin, Glen Waverley (AU)

(73) Assignee: Electrical Home-Aids Pty Ltd, Glen Waverley (AU)

( * ) Notice: Subject to any disclaimer, the term of this patent is extended or adjusted under 35 U.S.C. 154(b) by 51 days.

(21) Appl. No.: 15/748,968

(22) PCT Filed: Jul. 21, 2016

(86) PCT No.: PCT/AU2016/000259
§ 371 (c)(1),
(2) Date: Jan. 30, 2018

(87) PCT Pub. No.: WO2017/020063
PCT Pub. Date: Feb. 9, 2017

(65) Prior Publication Data

US 2019/0000287 A1 Jan. 3, 2019

(30) Foreign Application Priority Data

Jul. 31, 2015 (AU) ..... 2015903046
Mar. 10, 2016 (AU) ..... 2016900893

(51) Int. Cl.
*A47L 5/36* (2006.01)
*A45F 3/04* (2006.01)
(Continued)

(52) U.S. Cl.
CPC ..... *A47L 5/365* (2013.01); *A45F 3/04* (2013.01); *A45F 3/08* (2013.01); *A45F 3/14* (2013.01);
(Continued)

(58) Field of Classification Search
CPC ..... A47L 5/365; A47L 5/36; A47L 9/0081; A47L 9/22; A47L 9/14; A47L 5/14;
(Continued)

(56) References Cited

U.S. PATENT DOCUMENTS 5,267,371 A * 12/1993 Soler ..... A47L 5/36 15/327.5
D371,676 S * 7/1996 Geddes, Sr. ..... D3/216
(Continued)

FOREIGN PATENT DOCUMENTS

WO 2008/147256 A1 12/2008
WO 2009/042702 A1 4/2009

OTHER PUBLICATIONS

Full Examination Report dated Aug. 21, 2020 in related Australian Patent Application No. 2016302382 (four pages).

*Primary Examiner* — Robert J Scruggs
(74) *Attorney, Agent, or Firm* — Kilpatrick Townsend & Stockton LLP

(57) ABSTRACT

Disclosed is a vacuum cleaner assembly (10) including a harness assembly having a support bracket (11) and a vacuum cleaner (12) supported by the brackets (11). The brackets (11) are intended to be worn by a user so that the vacuum cleaner (12) is positioned adjacent the back of the user.

9 Claims, 14 Drawing Sheets

(51) Int. Cl.

| | |
|---|---|
| ***A45F 3/08*** | (2006.01) |
| ***A45F 3/14*** | (2006.01) |
| ***A47L 9/22*** | (2006.01) |
| ***A47L 9/00*** | (2006.01) |
| *A47L 9/14* | (2006.01) |

(52) U.S. Cl.
CPC ..... *A47L 5/36* (2013.01); *A47L 9/0081* (2013.01); *A47L 9/22* (2013.01); *A45F 2003/146* (2013.01); *A47L 9/14* (2013.01)

(58) Field of Classification Search
CPC .... A47L 5/225; A47L 9/00; A45F 3/04; A45F 3/08; A45F 3/14; A45F 2003/146; A01G 1/125; E01H 1/0809
See application file for complete search history.

(56) References Cited

U.S. PATENT DOCUMENTS

| | | | | |
|---|---|---|---|---|
| 7,509,706 | B2 * | 3/2009 | Clarke | A47L 9/2884 15/327.5 |
| 8,181,833 | B2 * | 5/2012 | Wangeby | A45F 3/14 224/262 |
| 9,167,751 | B2 * | 10/2015 | Thackery | A47L 5/36 |
| 2008/0172826 | A1 * | 7/2008 | Rappin | A01M 7/0021 15/405 |
| 2009/0095780 | A1 * | 4/2009 | Wangeby | A45F 3/14 224/262 |
| 2013/0061419 | A1 * | 3/2013 | Patrono | A47L 9/0081 15/326 |

* cited by examiner 60
61
62
63
113
75
92
77
90
90
70
91
91
92
90
71
65

61

90
90
90
90
90
91
90
90
91
90

HARNESS AND BACK PACK VACUUM CLEANER THEREFORE

This application is a U.S. National Phase Application of PCT/AU2016/000259, filed Jul. 21, 2016, which claims priority to Australian Provisional Application Nos. 2015903046, filed Jul. 31, 2015 and 2016900893, filed Mar. 10, 2016, the entireties of which are incorporated by reference herein.

TECHNICAL FIELD

The present invention relates to back pack vacuum cleaners, and more particularly to a harness to be worn by a person that is to use the vacuum cleaner.

BACKGROUND OF THE INVENTION

Vacuum cleaners, particularly industrial vacuum cleaners, are generally worn on the back of a person using the vacuum cleaner. These vacuum cleaners include an adjustable harness that is attached to the person, with the harness then supporting the vacuum cleaner. Known "backpack" vacuum cleaners have a number of disadvantages including the air outlet. Hot air leaving the vacuum cleaner is not directed away from the user causing the user discomfort. Some vacuum cleaners are also provided with a "blower" function. However, these vacuum cleaners are not well suited for use as a backpack.

Further disadvantages of known back pack vacuum cleaners, is that the harness assembly is often uncomfortable, typically if worn for considerable time, as in the case of professional cleaners. A further disadvantage is transmission of vibration from the vacuum cleaner to the harness to the wearer which is uncomfortable.

A still further disadvantage of known back pack vacuum cleaners is that the filter size is limited, thereby limiting the period over which the vacuum cleaner can be used. This necessitates the operator to be frequently emptying the collection chambers and filters.

OBJECT OF THE INVENTION

It is the object of the present invention to overcome or substantially ameliorate at least one of the above disadvantages.

SUMMARY OF INVENTION

There is disclosed herein a harness assembly for a back pack vacuum cleaner to be worn by a user, the harness assembly is to be positioned adjacent the user's back, the assembly including:

a lower bracket to engage the user's waist;

an upper bracket positioned above the lower bracket also to engage the user;

the brackets each being provided with means to engage the vacuum cleaner to support the vacuum cleaner, and wherein the upper bracket includes a base frame to be attached to the vacuum cleaner, and a plate movably attached to the frame to provide for height adjustment of the plate relative to the lower bracket.

Preferably, the assembly includes a plurality of mounting pads to attach the vacuum cleaner to the harness assembly, each mounting including a resilient portion to at least aid in limiting transmission of vibration from the vacuum cleaner to the harness assembly.

There is further disclosed herein a vacuum cleaner including:

a hollow body having a front surface and a rear surface adjacent a user of the vacuum cleaner, and providing an air inlet and an air outlet;

a motor mounted within the body;

a fan mounted within the body and driven by the motor to move air from the inlet to the outlet;

a filter mounted in the body between the inlet and outlet and through which the air is moved by the fan; and wherein the outlet is at said front surface and includes a first air outlet duct, and a second air outlet duct, with at least one of the ducts being closeable.

Preferably, the first air outlet duct is a vent that is at least partly directed upwardly and is not closeable.

Preferably, the second air outlet duct is closeable by means of a cap so that when closed air leaving the vacuum cleaner leaves only via the vent.

Preferably, the air outlet is positioned adjacent a lower portion of the body.

There is disclosed herein a backpack vacuum cleaner assembly, including the above vacuum cleaner, and a harness to be worn by the user, with the harness adapted to engage the vacuum cleaner so that the rear surface is adjacent the user.

Preferably, the harness includes an upper portion to engage the vacuum cleaner, and a lower portion to engage the vacuum cleaner, with the upper and lower portions being connected by padding to secure the upper and lower portions together.

Preferably, the harness includes vibration insulation pads that at least aid in inhibit vibration being transmitted from the vacuum cleaner to the wearer.

There is disclosed herein a harness assembly for a back pack vacuum cleaner to be worn by a user, the harness assembly is to be positioned adjacent the user's back, the assembly including:

an upper bracket to be positioned adjacent an upper portion of the user;

a lower bracket to engage the user's waist, the lower bracket being attached to the upper bracket, so that the upper bracket is positioned above the lower bracket, the lower bracket including a central part with a pair of diverging rearwardly extending arms between which the vacuum cleaner is to be located;

and a plurality of resilient pads, at least one pad being attached to the upper bracket and to be attached to the vacuum cleaner, and with each arm having a respective one of the resilient pads attached thereto and that are to be attached to the vacuum cleaner, with the pads being adapted to inhibit the transmission of vibration from the vacuum cleaner to the harness and therefore the user.

Preferably, the assembly includes a further resilient pad, the further resilient pad being attached to the lower bracket adjacent the central part and being adapted to be attached to the vacuum cleaner.

Preferably, the upper bracket includes a pair of diverging rearwardly extending arms between which the backpack vacuum cleaner is to be located, with each of the arms, with each upper bracket arm having a respective one of the resilient pads to be attached to the vacuum cleaner.

Preferably, the harness further includes a resilient pad located between the arms of the upper bracket and fixed to the upper bracket and to be attached to the vacuum cleaner.

Preferably, the upper bracket is attached to the lower bracket to provide for height adjustment therebetween.

Preferably, the harness further includes a resilient coupling attached to the upper bracket or the lower bracket, the resilient coupling being adapted to engage a cord of the vacuum cleaner to attach the cord to the harness.

Preferably, the coupling includes a resilient deformable strap to attach the cord to the upper or lower bracket.

Preferably, the coupling is attached to the upper bracket.

Preferably, the harness further includes a support attached to and extending downward from the central part upon which the harness, with vacuum cleaner attached, can rest and be maintained in a generally upright orientation.

BRIEF DESCRIPTION OF DRAWINGS

Preferred forms of the present invention will now be described by way of example with reference to the accompanying drawings wherein.

DETAILED DESCRIPTION OF THE PREFERRED EMBODIMENTS

Figure 1:
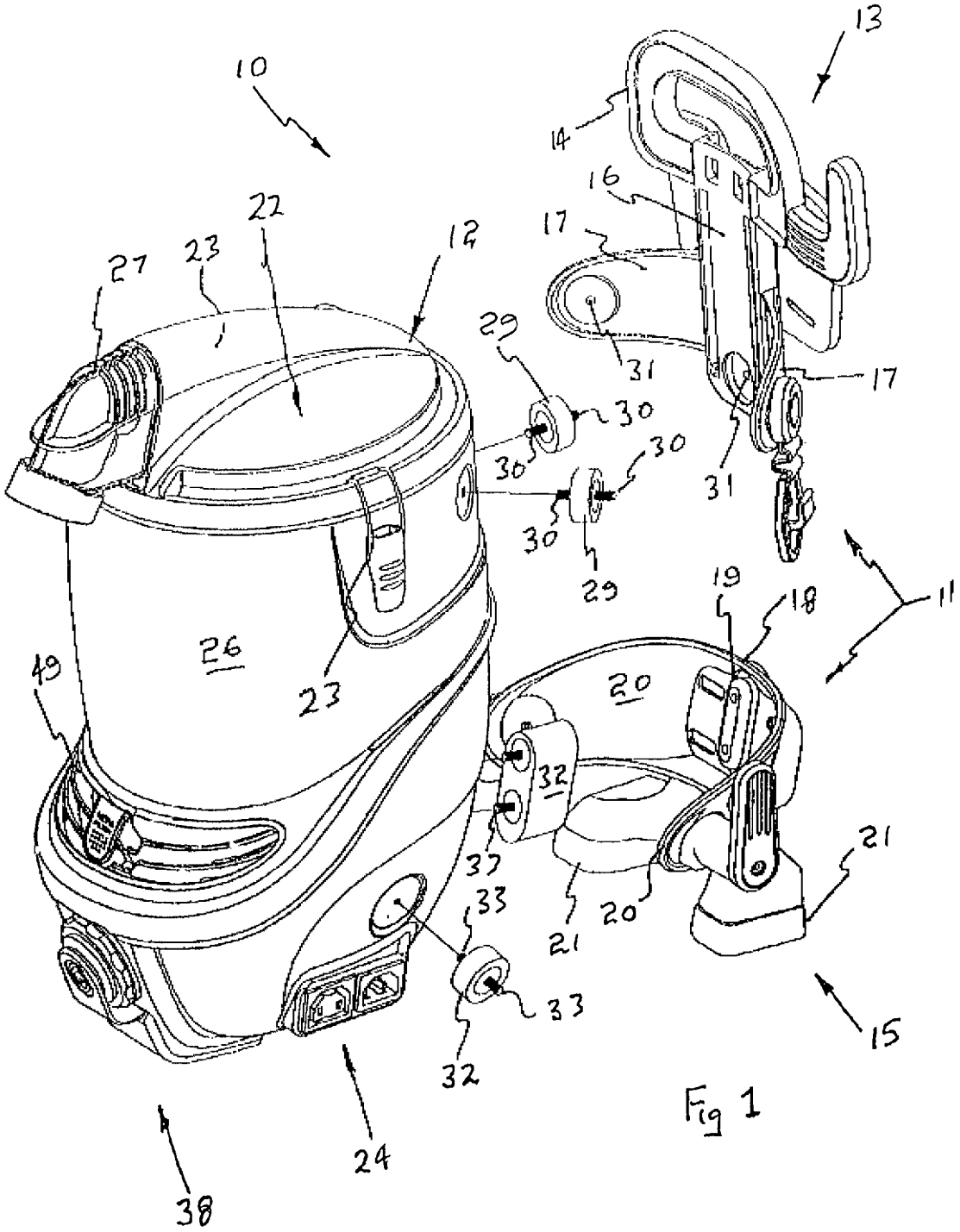
FIG. 1 is a schematic parts exploded isometric view of a backpack vacuum cleaner.
Figure 2:
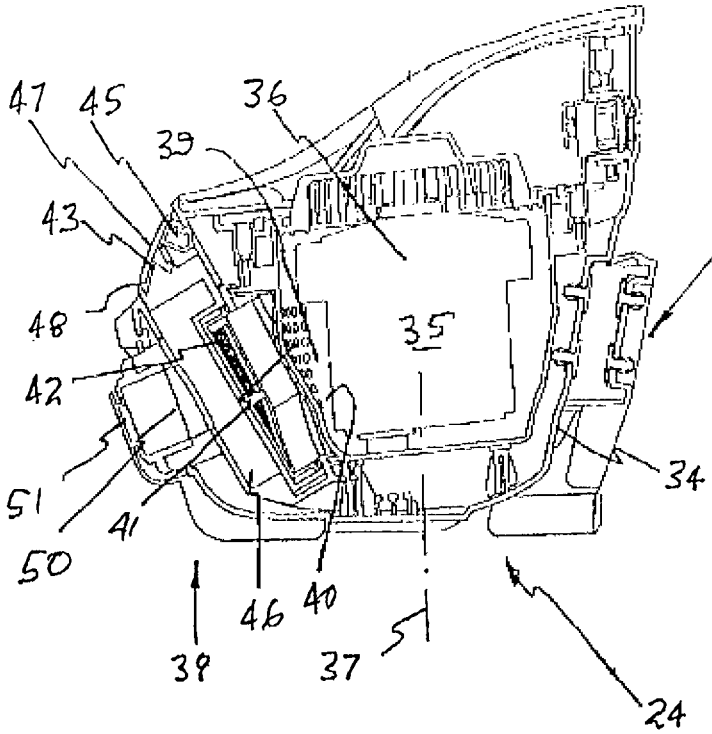
FIG. 2 is a schematic section side elevation of a lower part of the vacuum cleaner of FIG. 1.
Figure 3:
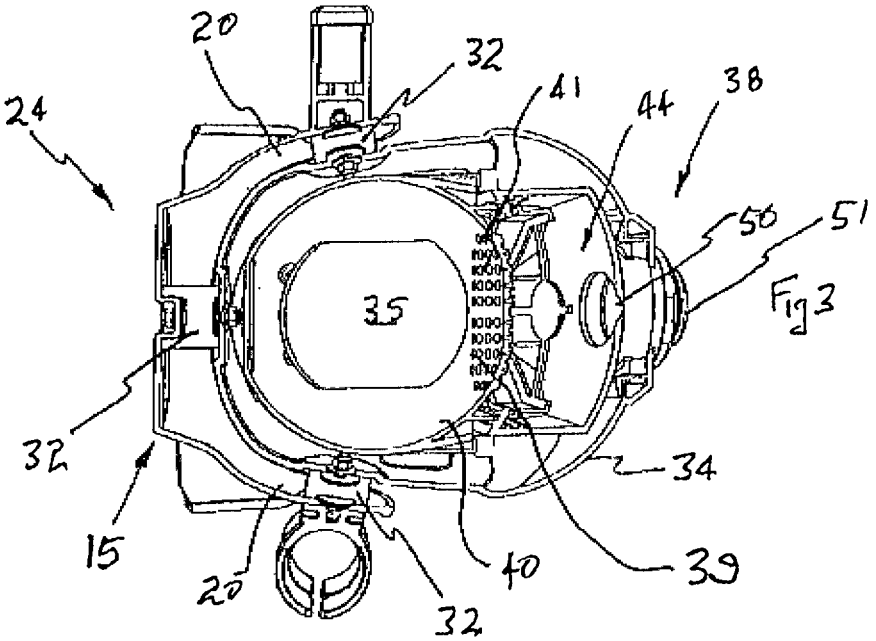
FIG. 3 is a schematic section top plan view of the lower part of FIG. 1.

In FIGS. 1 to 3 of the accompanying drawings, there is schematically depicted a backpack vacuum cleaner assembly 10 including a harness assembly having a support brackets 11 and a vacuum cleaner 12 supported by the brackets 11. The brackets 11 are intended to be worn by a user so that the vacuum cleaner 12 is positioned adjacent the back of the user. The forward part of the assembly 10 is located adjacent the user.

The brackets 11 of the harness assembly includes a lower harness bracket 15, and an upper harness bracket 13 that are intended to be located adjacent an upper portion of the user's back. The bracket 13 includes a handle 14, and a plate 16 to be positioned adjacent the back of the user, and that has padding (not illustrated). Extending from the plate 16 are diverging arms 17 that are spaced and between which portion of the vacuum cleaner 12 is located. The plate 16 provides adjustment for different height users.

The bracket 15 includes an arcuate plate 18 that is engaged by padding, and that is intended to be positioned adjacent the wearer (user). The plate 18 provides a central part 19 from which there extends a pair of arms 20 between which part of the vacuum cleaner 12 is located. Extending downwardly from the central part 19 are supports 21 that engage a generally horizontal surface when the vacuum cleaner is placed on the surface so as to be supported thereby. The supports 21 engage the supporting surface so that the backpack vacuum cleaner assembly 10 is generally upwardly oriented.

Preferably, the brackets 13 and 15 each have their main items moulded of plastics material.

The above-mentioned padding engages the plate 16, and central part 19 so as to secure the brackets 13 and 15 in an appropriate relationship relative to the person that is to use the vacuum cleaner assembly 10.

The vacuum cleaner 12 includes a hollow body 22 that includes a removable cap 23 secured to a generally cylindrical central portion 26 by catches 25. Located in the central portion 26 is a filter (not illustrated) that can be serviced by removal of the cap 23.

The cap 23 includes an air inlet 27 to which a vacuum cleaner duct (hose) is attached and gripped by the user.

Fixed to the central portion 26 is a lower sub-assembly 24 best seen in FIGS. 2 and 3. The sub-assembly 24 includes a hollow casing 34.

Attached to each of the arms 17 is a resilient pad 29 that secures the vacuum cleaner 12 to the harness. Each resilient pad 29 is provided with a pair of threaded shafts 30 that are separated by resilient material, and that engages the central portion 26 of the vacuum cleaner 12, apertures 31 in the arms 17, and central portions 16, to attach the bracket 13 to the vacuum cleaner 12.

Further resilient pads 32 engage the casing 34, the arms 20, and central part 19 of the bracket 15 to secure the casing 34 to the bracket 15.

The resilient pads 32 each include threaded shafts 33 that are separated by resilient material.

The resilient pads 29 and 32 aid in insulating vibration from the wearer of the vacuum cleaner backpack assembly 10.

Located within the hollow casing 34 is a motor 35. Attached to the motor 35 and driven thereby is a fan 36 that is rotated about the rotational axis 37 of the motor 35. The fan 36 is driven to draw air in through the air inlet 27, and to deliver the air to an outlet 38.

Upon operation of the motor 35 air enters the inlet 27 and passes through the filter in the central portion 26, to be delivered, via the motor 35, to a cavity 39 of the casing 34 generally surrounding the motor 35. Surrounding the cavity 39 is a plate 40 having apertures 41 through which air passes to be delivered to a filter 42.

The filter 42 is located in a mounting 43 slidingly received within a slot 44 in the sub-assembly 24. A user manipulated catch 45 retains the mounting 43 in position, and is operated to provide for removal of the mounting 43 for the purposes of servicing the filter 42.

Air passing through the filter 42 is delivered to a cavity 46 of the casing 34, and provides for delivery of outgoing air to the vent 47. The vent 47 is included in an upwardly facing surface 48 and has vent blades 49 that aid in directing the airstream up and rearwardly away from the wearer of the vacuum cleaner backpack assembly 10. The vent 37 is open.

The abovementioned casing 34 includes the mounting 43, with the mounting 43 including upwardly and rearwardly facing surface 48 that provides the vent 47.

Also communicating with the cavity 46 is a blower (duct) 50 that is closed via a cap 51. Removal of the cap 51 allows air to exit via the duct 50, with the duct 50 adapted to receive a hose so that the backpack assembly 10 can be used as a "blower".

The vent 47 is located adjacent the blower duct 50 with the vent 47 and duct 50 being located on a rear facing portion of the assembly 10.

In FIGS. 4 to 14 of the accompanying drawings there is schematically depicted a back pack vacuum cleaner assembly 60 that is a modification of the back pack vacuum cleaner assembly 10 of FIGS. 1 to 3.

The assembly 60 includes a harness assembly 61 that supports a vacuum cleaner 62. The harness 61 is intended to be worn by a user so that the vacuum cleaner 62 is positioned adjacent the back of the user. The forward part of the assembly 60 is located adjacent the user.

The harness assembly 61 includes a lower harness bracket 65, as is intended to be located just above the hips of the user, and an upper harness bracket 63 that is intended to be located adjacent an upper portion of the user's back. The bracket 63 includes a handle 64 and a plate 66 to be positioned adjacent the back of the user. The bracket 65 is provided with padding as best seen in FIG. 4.

The bracket 63 also provides for height adjustment to provide for users of different heights.

Figure 4:
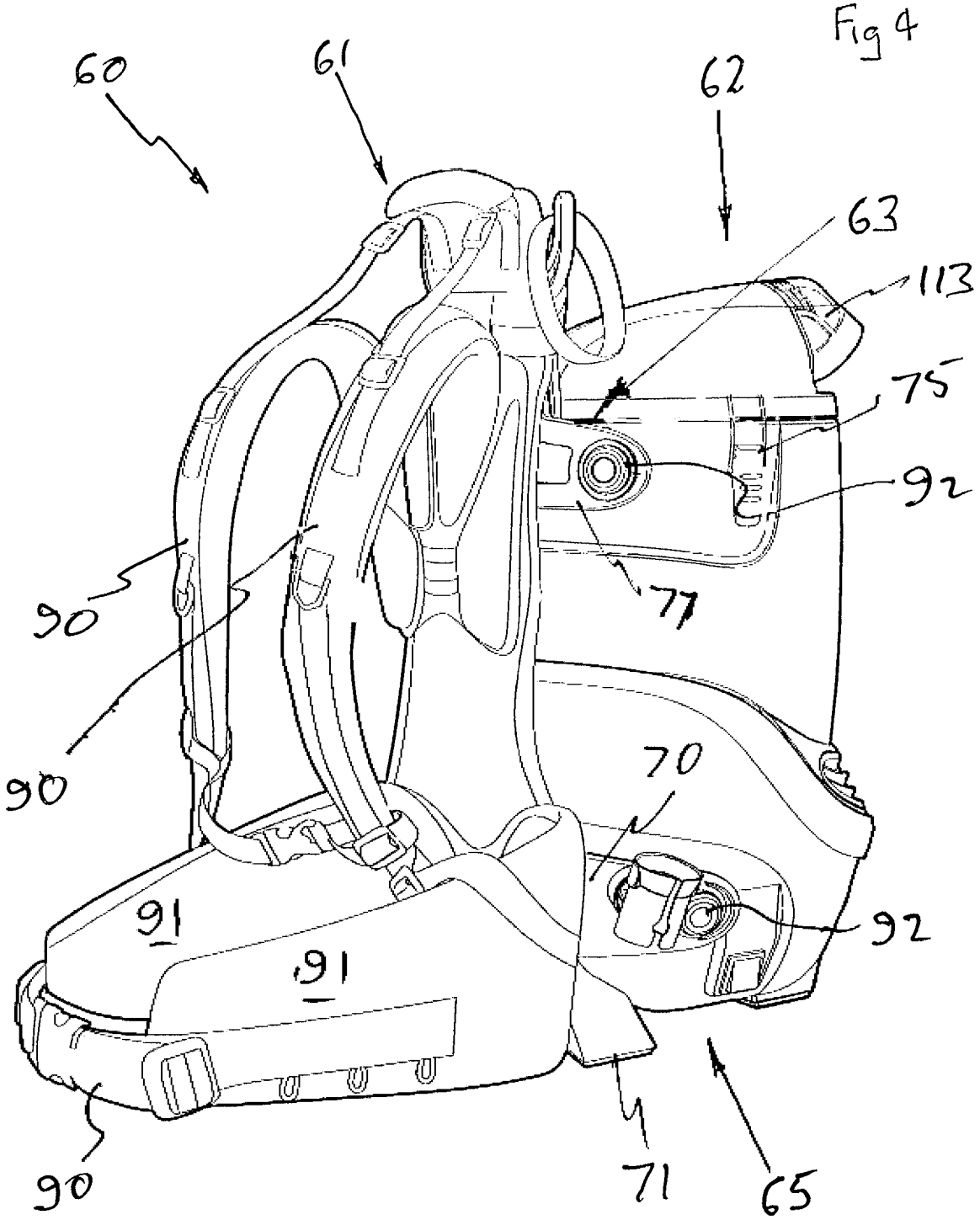
FIG. 4 is a schematic isometric view of a modification of the back pack vacuum cleaner of FIG. 1.
Figure 5:
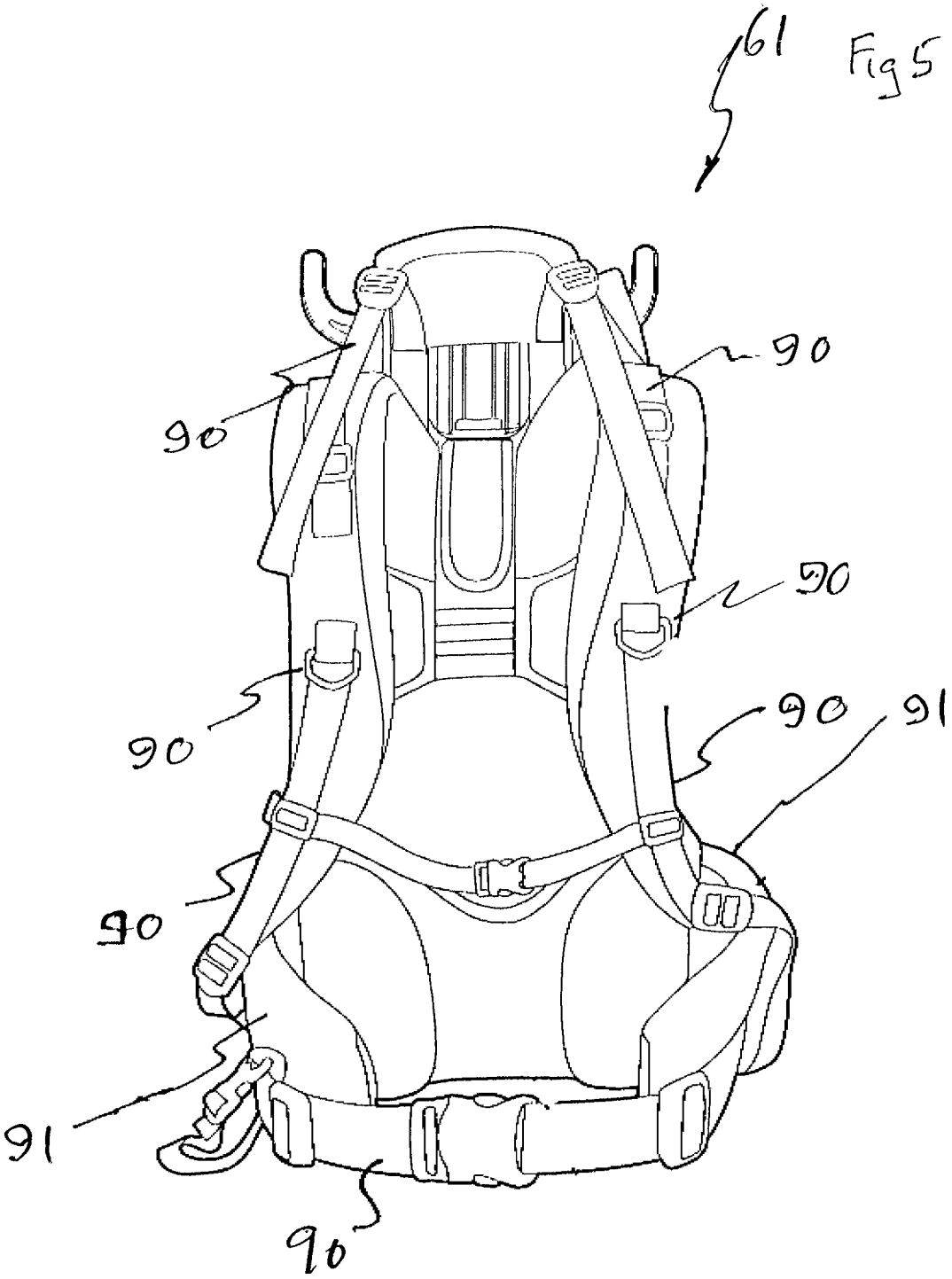
FIG. 5 is a schematic front elevation of the harness of the back pack vacuum cleaner of FIG. 4.
Figure 6:
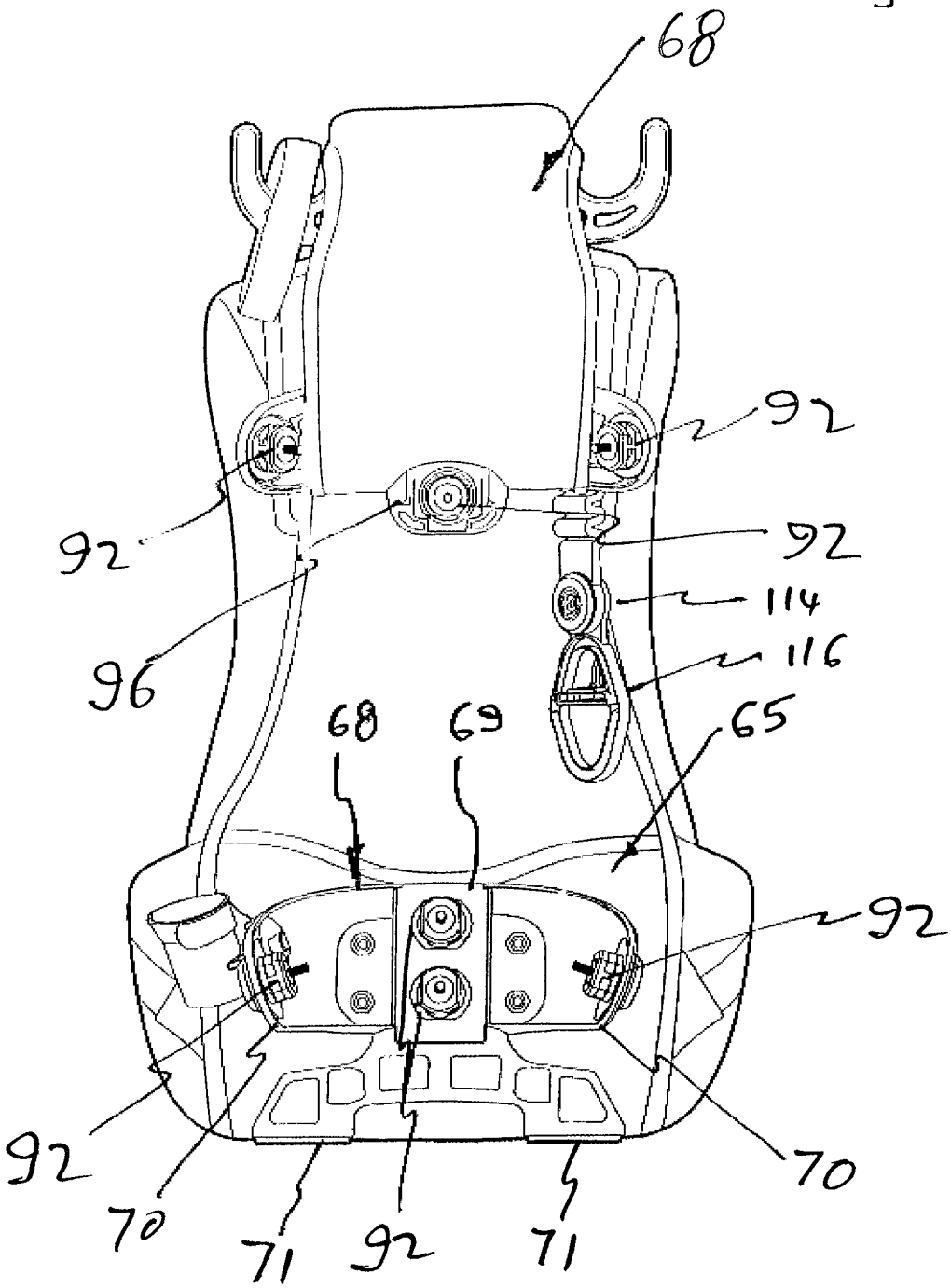
FIG. 6 is a schematic elevation of the harness assembly of FIG. 4.
Figure 7:
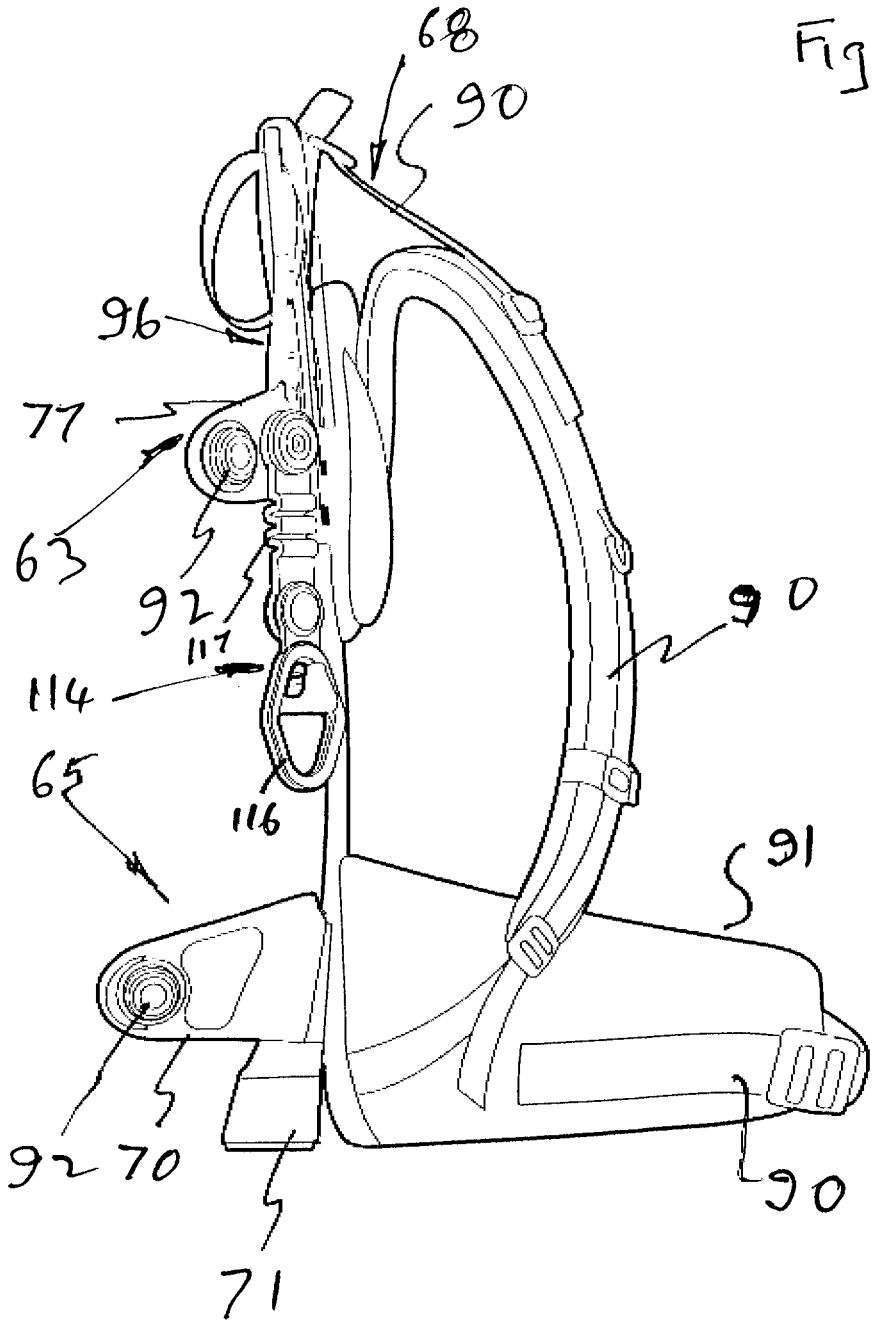
FIG. 7 is a schematic side elevation of the harness assembly as shown in FIG. 6.
Figure 9:
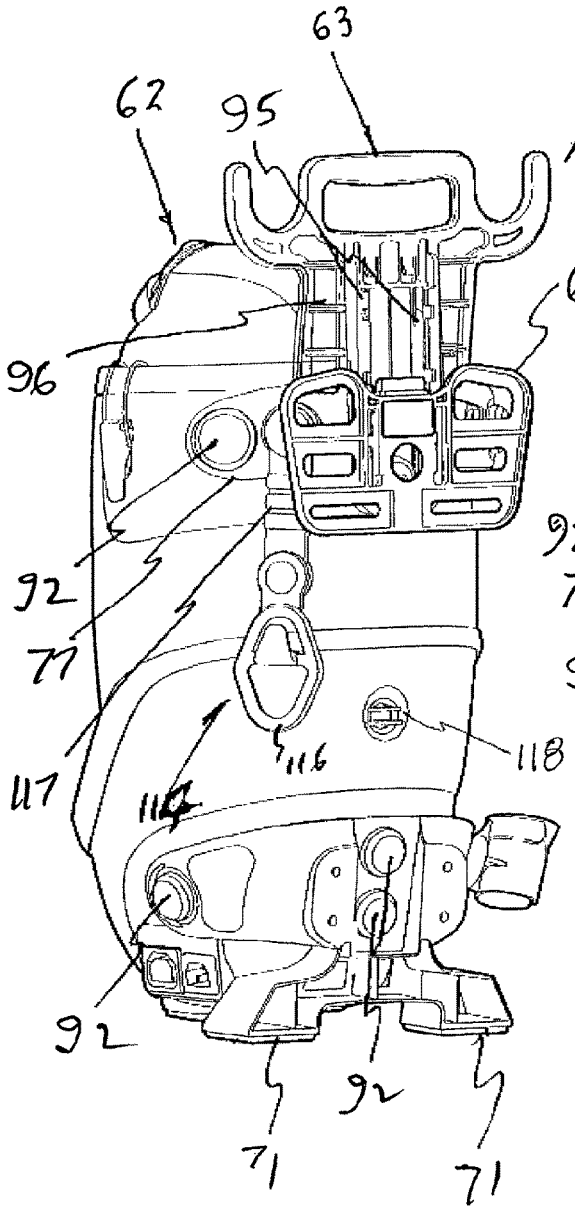
FIG. 9 is a further schematic isometric view of the back pack and harness portion of FIG. 8.
Figure 8:
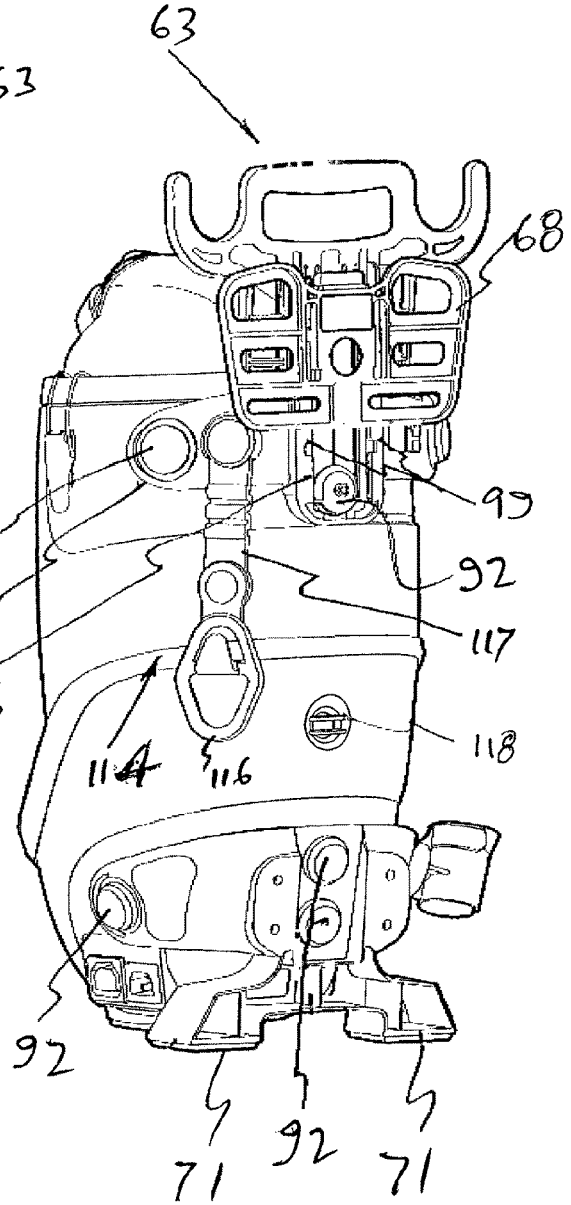
FIG. 8 is a schematic isometric view of the vacuum cleaner and portion of the harness of the back pack vacuum cleaner of FIG. 4.
Figure 10:
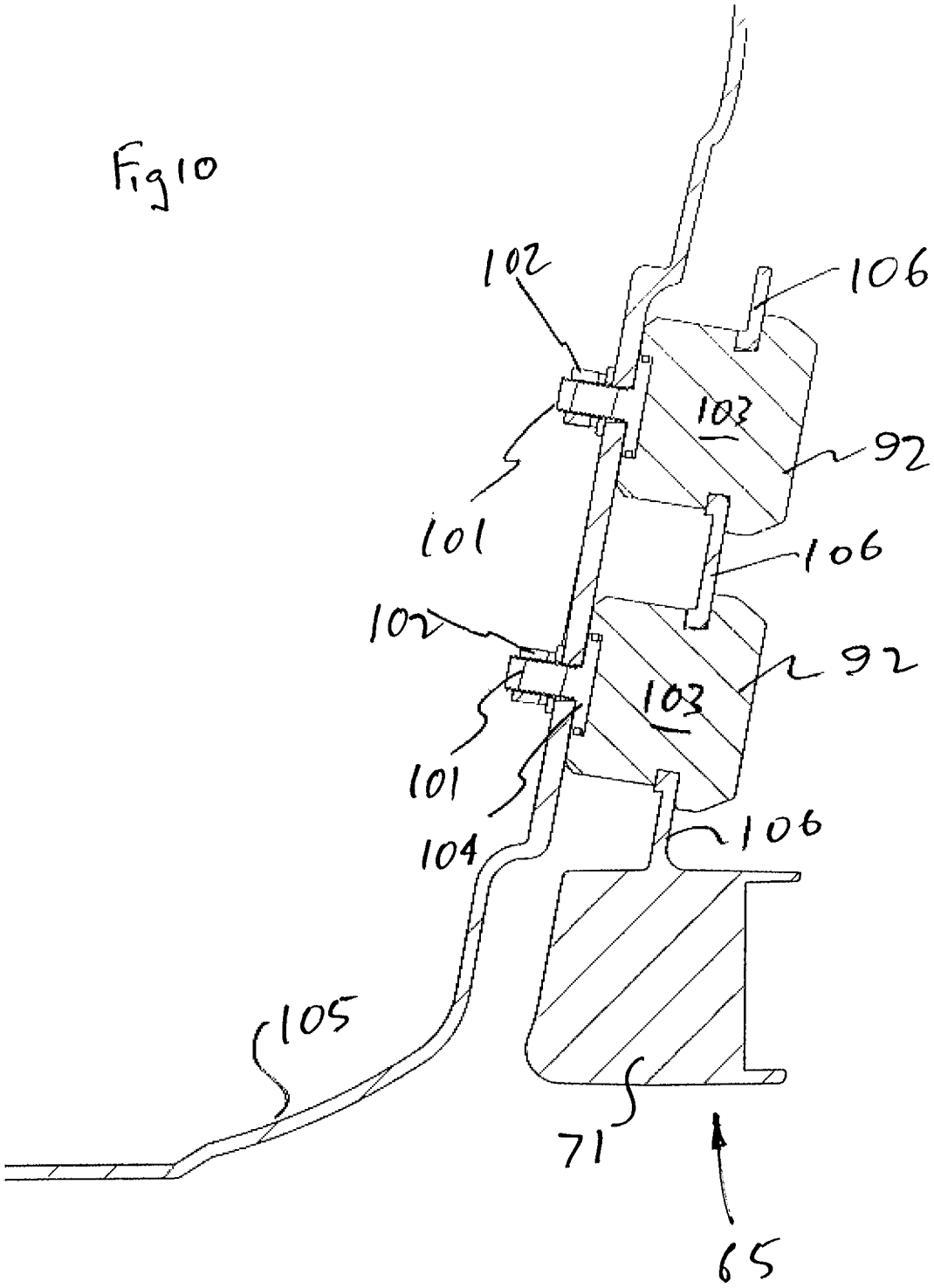
FIG. 10 is a schematic sectioned side elevation of a mounting portion of the back pack vacuum cleaner of FIG. 4.
Figure 11:
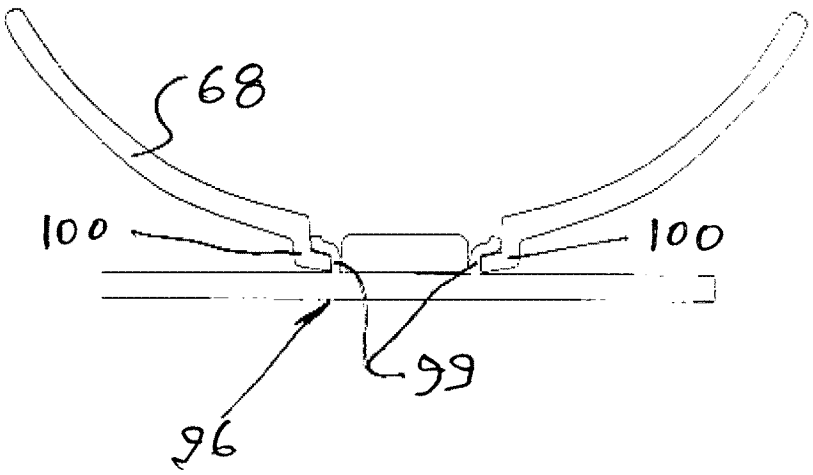
FIG. 11 is a schematic top plan view of portion of the frame of the harness of FIG. 5.
Figure 12:
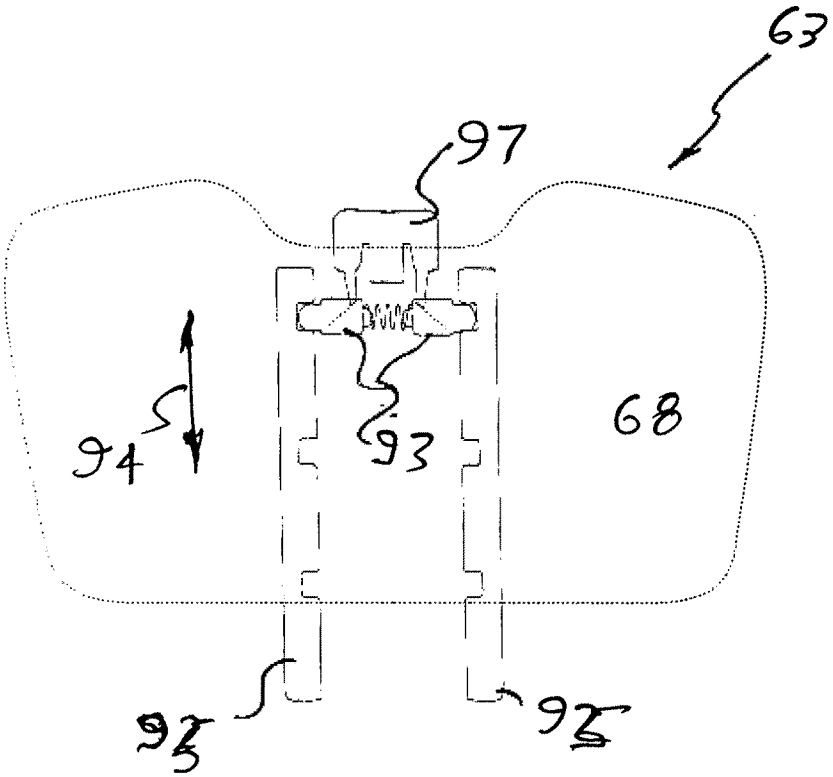
FIG. 12 is a schematic elevation of the frame portion of FIG. 11.
Figure 13:
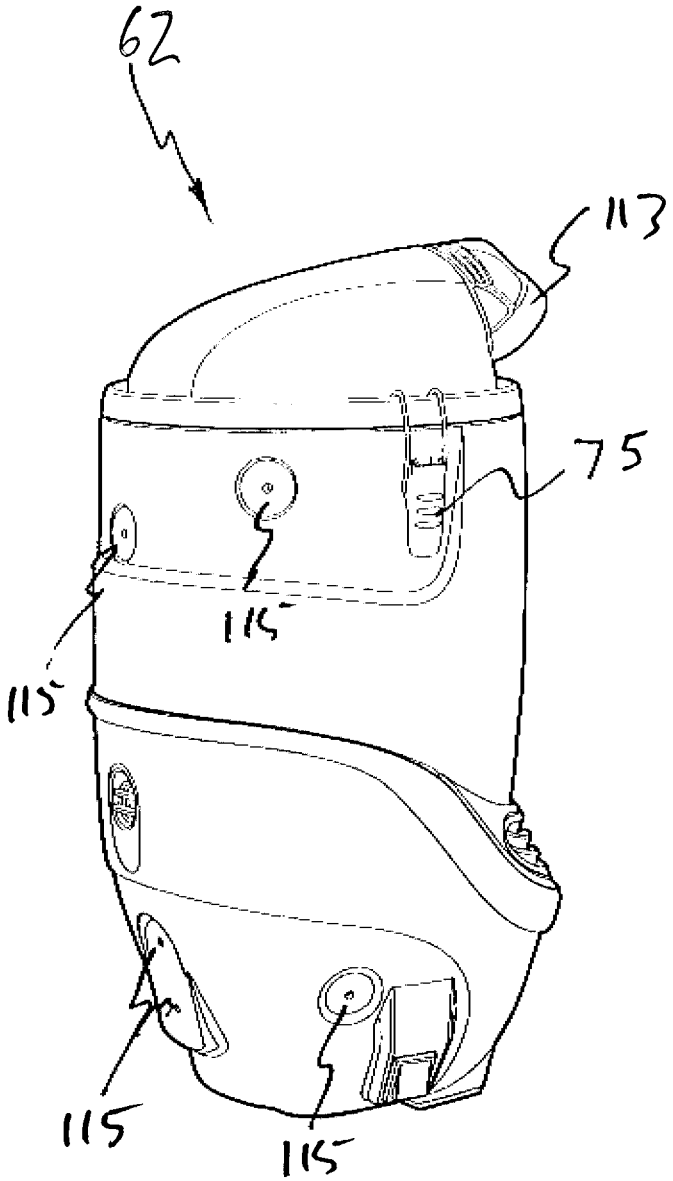
FIG. 13 is a schematic isometric view of the vacuum cleaner of the vacuum cleaner back pack of FIG. 4.
Figure 14:
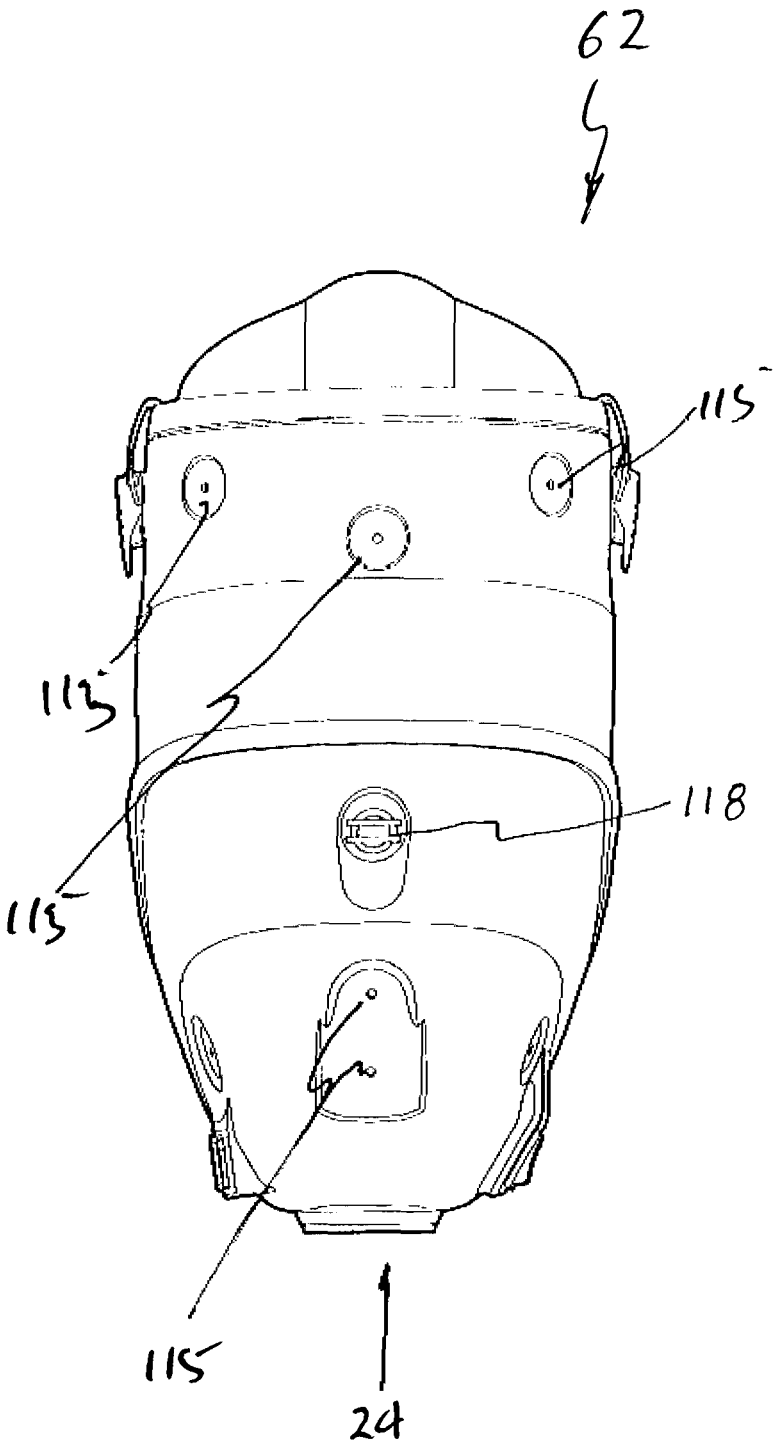
FIG. 14 is a schematic rear elevation of the vacuum cleaner of FIG. 13.
Figure 15:
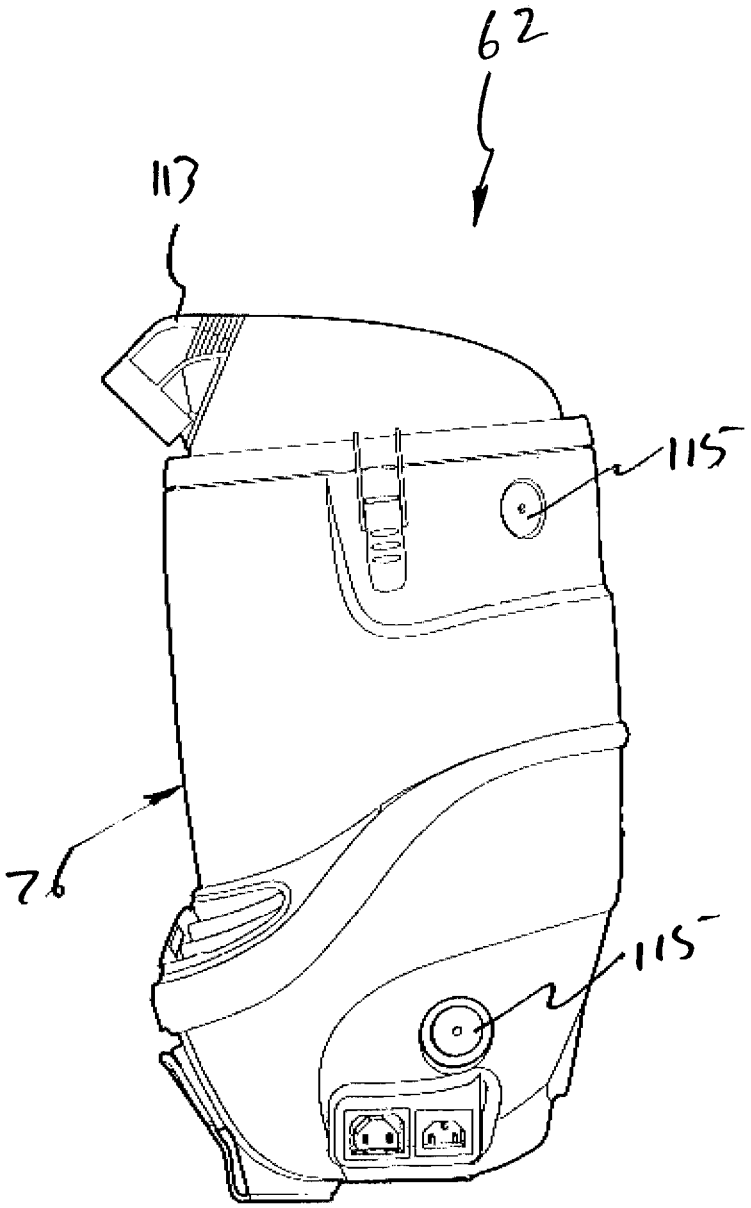
FIG. 15 is a schematic side elevation of the vacuum cleaner of FIG. 13.

The bracket 65 includes an arcuate plate 68 that is engaged by padding, as best seen in FIG. 4, and that is intended to be positioned adjacent the wearer. The plate 68 provides a central part 69 from which there extends a pair of arms 70 between which the vacuum cleaner 62 is located and supported thereby. Extending downwardly from the central part 69 are supports 71 that engage a generally horizontal surface when the vacuum cleaner back pack assembly 60 is placed on the surface so as to be supported thereby. The supports 21 engage the supporting surface so that the back pack vacuum cleaner assembly 70 is generally upwardly oriented.

Preferably, the brackets 63 and 65 each have their main items moulded of plastics material.

The harness assembly 61 also includes straps 90, that pass around the front of the user, including around the waist and over the shoulders, the straps are adjustable in respect of length.

Also projecting from the plate 68, is a further pair of arms 91 that project in the opposite direction to the arms 70 and which pass about the waist of the user to aid in securing the back pack assembly 60 to the user in a comfortable manner.

The upper bracket 63 and the lower bracket 65 are attached to the vacuum cleaner 62 by resilient mountings 92.

With reference to the upper bracket 63, the mountings 92 are attached to a base frame 96 of the bracket 63, and the vacuum cleaner 62.

The base frame 96 includes ratchet members 95 that provide for height adjustment for the plate 68 relative to the vacuum cleaner 62. In particular, the plate 68 has attached to it a pair of pawls 93 that are activated by the user manipulating the tab member 97 to move the pawls 93 inwardly from engagement with the ratchet members 95, thereby enabling movement of the plate 68 relative to the base frame 96.

With the vacuum cleaner 62 is attached to the base frame 96 and the lower bracket 65, the frame 96 is retained fixed in distance from the bracket 65 so that height adjustment is accomplished by moving the plate 68 relative to the base frame 96.

The base frame 96 also includes a pair of channel members 99 that slidably engage flanges 100 of plate 68 to guide the plate 68 in its movement in the direction 94.

Each of the mountings 92 includes a resilient pad 103 fixed to a threaded shaft 101 by means of a flange 104. The threaded shaft 101 is engaged by a nut 102, with the nut 102 and flange 104 securing the mounting 92 to the associated part of the vacuum cleaner 62. As an example, with reference to FIG. 10, the mountings 92 attach the lower bracket 65 to a portion 105 of the vacuum cleaner 62. The bracket 65 is attached to the resilient pads 103 by flanges 106. The pads 103 may be of a resilient plastics material, or a synthetic or natural rubber so as to absorb the vibration and inhibit the transmission of vibration from the vacuum cleaner 62 to the harness assembly 61.

Each of the mountings 92 is arranged so the connection between each flange 104 and its associated portion of brackets 63 or 65 (identified by reference numeral 106) is through the resilient pad 103, to provide for the absorption of vibration.

The mountings 92 are arranged so that there are two mountings 92 at the central portion 69, a mounting 92 in each of the arms 70, a mounting 92 at a lower portion of the frame 96, as well as two further mountings 92 in the arms 70 of the frame 96. Accordingly, there are corresponding mounting locations 115 on the vacuum cleaner 62. At each location 115, the associated shaft 101 and nut 102 secure the mounting 92 to the vacuum cleaner 62.

The vacuum cleaner 62 includes a hollow body 72 that includes a removable cap 73 secured to a generally cylindrical central portion 76 by catches 75.

Preferably, the assembly includes a coupling 114 fixed to one of the arms 77, the coupling 114 being resilient and including an eyelet 116 to engage the cord for the vacuum cleaner 62. The coupling 114 also includes a strap 117, that is resiliently deformable to absorb forces applied to the coupling 114 by a power cord. Preferably, the strap 117 is serpentine in configuration, and is resiliently straightened to absorb pull forces.

The generally cylindrical central portion 76 is of a cylindrical configuration providing a filter chamber. The filter chamber has a filter screen 108 that supports a filter bag 107 that surrounds a central filter cavity 112. Abutting the screen 108 is a cylindrical filter 109. Air enters the inlet to be delivered to the cavity 112, from where air passes through the filter bag 107, screen 108 and filter 109 to be delivered to an annular cavity 111. The air passes from the cavity 112 to the cavity 111 in the direction 110.

Preferably the vacuum cleaner 62 includes an air bleed valve 118 that provides for the flow of air from external of the vacuum cleaner 62 to the cavity 111. As the cavity 111 is subjected to a reduced air pressure, air is drawn in through the valve 118. Air being drawn into the valve 118 causes air flow about the user, and in particular aids in removing hot air from around the user. Preferably the air bleed valve 118 is positioned slightly above the lower harness bracket 55.

Figure 16:
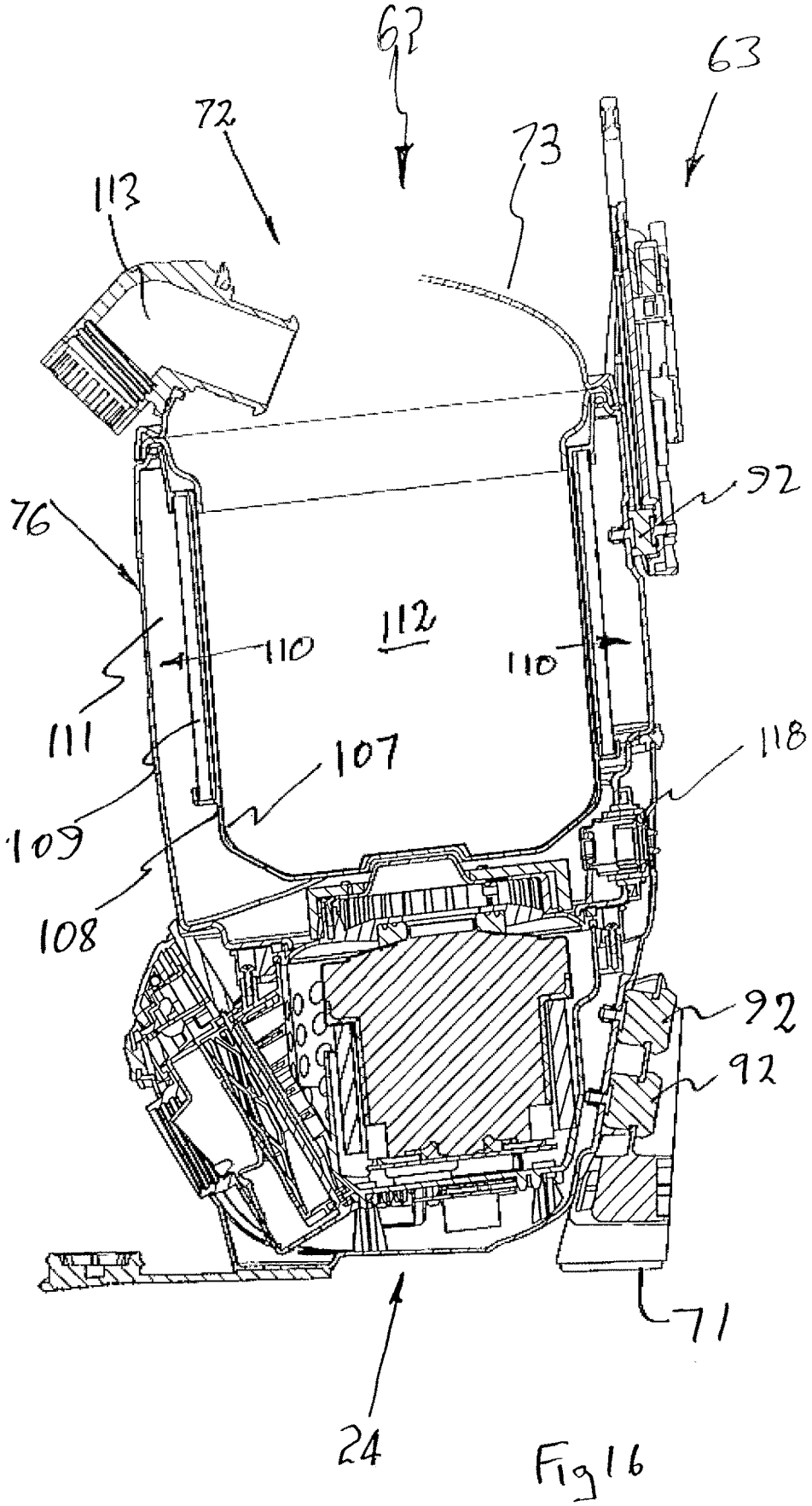
FIG. 16 is a schematic sectioned side elevation of the vacuum cleaner of FIG. 13.
Figure 17:
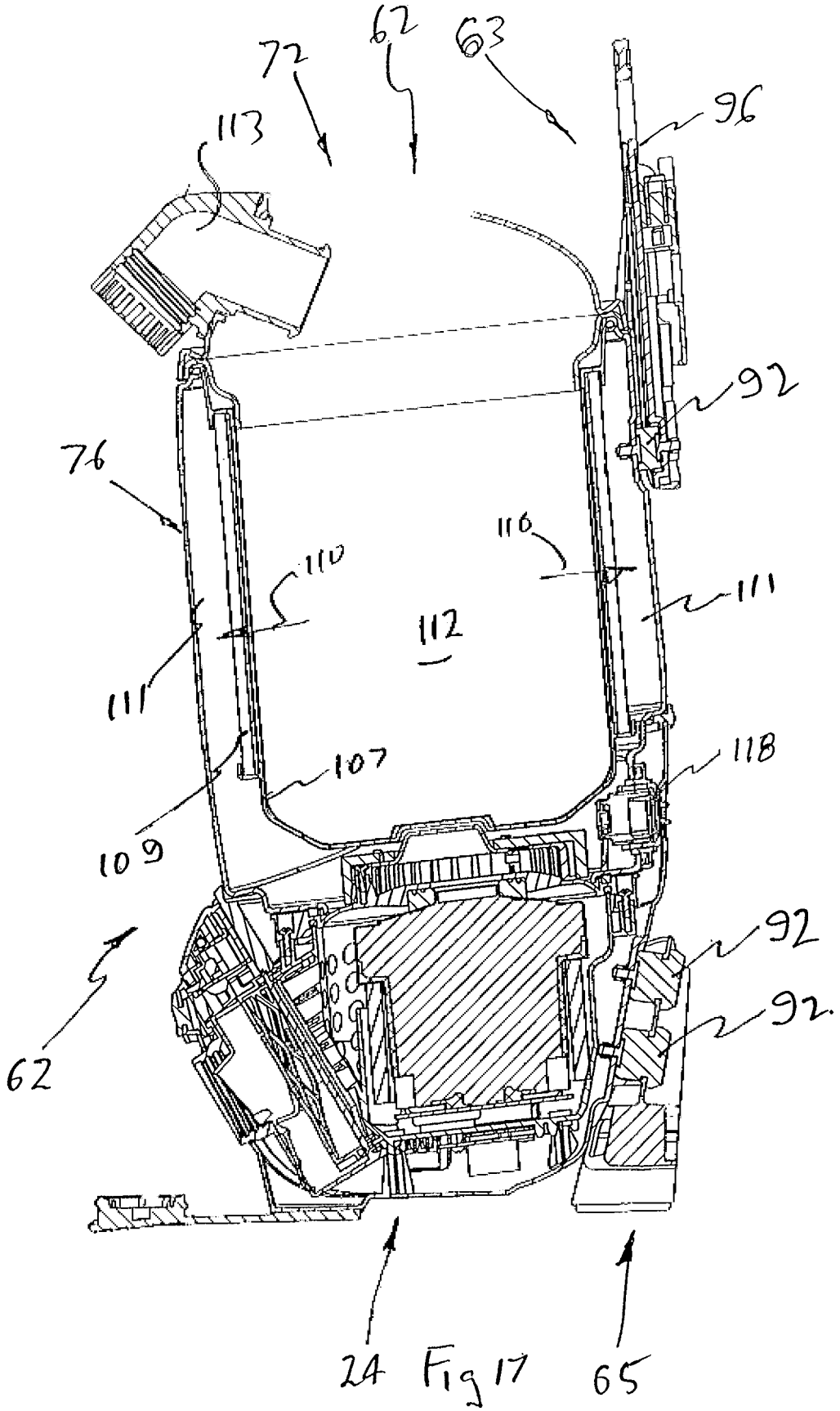
FIG. 17 is a schematic sectioned side elevation of a modification of the vacuum cleaner as shown in FIG. 16.

In this embodiment the vacuum cleaner back pack assembly 60 includes the lower sub-assembly 24 described with reference to FIGS. 2 and 3. As a further modification of the above described preferred embodiments, the central portion 76 can be of different sizes. For example, in FIG. 16, a smaller central portion 76 is illustrated, while in FIG. 17 a larger central portion 76 is illustrated. Accordingly, the central portion 76 is removably attached to the sub-assembly 24, with each central portion 76 co-operating with the removal cap 23. With the larger central portions 76 installed, a larger filter capacity is provided, that is a larger filter bag 107 can be employed and a larger filter 111, with an increase in the cavity 112 in respect of volume.

The invention claimed is:

1. A harness assembly for a back pack vacuum cleaner to be worn by a user, wherein the harness assembly is configured to be positioned adjacent the user's back, the harness assembly comprising:

an upper harness bracket configured to be positioned adjacent an upper portion of the user;

a lower harness bracket separate from the upper harness bracket and configured to be positioned adjacent the user's waist, wherein the lower harness bracket is attached to the upper bracket with padding so that the upper harness bracket is positioned above the lower harness bracket, wherein the lower harness bracket comprises a central part and a pair of diverging rearwardly extending arms extending from the central part, and wherein the pair of diverging rearwardly extending arms are configured to receive the vacuum cleaner between the pair of diverging rearwardly extending arms; and a plurality of resilient pads comprising at least one pad attached to the upper bracket and configured to be attached to the vacuum cleaner, wherein each arm is coupled to a respective one of the plurality of resilient pads, wherein the resilient pads coupled to the arms are configured to be attached to the vacuum cleaner, and wherein the resilient pads coupled to the arms are configured to inhibit transmission of vibration from the vacuum cleaner to the harness and the user.

2. The harness of claim 1, wherein the assembly includes a further resilient pad, wherein the further resilient pad is attached to the lower harness bracket adjacent the central part and is configured to be attached to the vacuum cleaner.

3. The vacuum cleaner of claim 1, wherein the upper harness bracket includes a second pair of diverging rearwardly extending arms between which the backpack vacuum cleaner is to be located, with each of the arms, with each upper bracket arm having a respective one of the resilient pads to be attached to the vacuum cleaner.

4. The harness assembly of claim 3, further including a resilient pad located between the arms of the upper harness bracket and fixed to the upper bracket and to be attached to the vacuum cleaner.

5. The harness assembly of claim 4, wherein the upper harness bracket is attached to the lower harness bracket to provide for height adjustment therebetween.

6. The harness assembly of claim 1, further comprising a resilient coupling attached to the upper bracket or the lower harness bracket, wherein the resilient coupling is configured to engage a cord through an eyelet on the coupling of the vacuum cleaner to attach the cord to the harness.

7. The harness assembly of claim 6, wherein the coupling comprises a resilient deformable strap configured to attach the cord to the upper or lower bracket.

8. The harness assembly of claim 6, wherein the coupling is attached to the upper harness bracket.

9. The harness assembly of claim 8, further comprising a support attached to and extending downward from the central part upon which the harness, with vacuum cleaner attached, is configured to rest and be maintained in a generally upright orientation.

* * * * *